US005657633A

United States Patent [19]

Brueggert

[11] Patent Number: 5,657,633

[45] Date of Patent: Aug. 19, 1997

[54] CENTERBODY FOR A MULTIPLE ANNULAR COMBUSTOR

[75] Inventor: Marlin S. Brueggert, Cincinnati, Ohio

[73] Assignee: General Electric Company, Cincinnati, Ohio

[21] Appl. No.: 581,709

[22] Filed: Dec. 29, 1995

[51] Int. Cl.[6] ..... F02C 7/00

[52] U.S. Cl. ..... 60/747; 60/752

[58] Field of Search ..... 60/39.36, 733, 60/737, 747, 752, 755, 757

[56] References Cited

U.S. PATENT DOCUMENTS

| | | | |
|---|---|---|---|
| 4,158,949 | 6/1979 | Reider | 60/39.32 |
| 4,480,436 | 11/1984 | Maclin | 60/39.32 |
| 4,492,078 | 1/1985 | Williamson | 60/39.31 |
| 5,197,278 | 3/1993 | Sabla et al. | 60/39.02 |
| 5,285,632 | 2/1994 | Halila | 60/39.31 |
| 5,285,635 | 2/1994 | Savelli et al. | 60/39.36 |
| 5,289,687 | 3/1994 | Kress et al. | 60/747 |
| 5,291,732 | 3/1994 | Halia | 60/39.31 |
| 5,321,951 | 6/1994 | Falls et al. | 60/748 |
| 5,323,604 | 6/1994 | Ekstedt et al. | 60/39.36 |
| 5,375,420 | 12/1994 | Falls et al. | 60/752 |
| 5,417,069 | 5/1995 | Alary et al. | 60/747 |
| 5,421,158 | 6/1995 | Stenger et al. | 60/747 |

FOREIGN PATENT DOCUMENTS 0564170 3/1993 European Pat. Off. .

*Primary Examiner*—Charles G. Freay

*Attorney, Agent, or Firm*—Andrew C. Hess; Wayne O. Traynham

[57] ABSTRACT

A multiple annular combustor for a gas turbine engine is disclosed having a plurality of concentrically disposed annular combustion zones about a centerline axis. The multiple annular combustor includes a first annular combustion zone, a second annular combustion zone, and a centerbody disposed between the first and second annular combustion zones. The centerbody has a first wall extending axially from an upstream end to a downstream end and a second wall radially spaced from the first wall extending axially from an upstream end to a downstream end, where the downstream ends of the first and second walls are connected by an aft wall and a pair of side walls to form a passage therebetween. The centerbody is geometrically configured to cause a thermoelastic neutral axis to be positioned radially with respect to the first and second walls thereof so that thermal stress imposed on the first and second walls is minimized. The upstream ends of the first and second walls are connected directly to a dome plate defining the first and second annular combustion zones or to a heat shield positioned within openings of the dome plate.

20 Claims, 3 Drawing Sheets

CENTERBODY FOR A MULTIPLE ANNULAR COMBUSTOR

BACKGROUND OF THE INVENTION

1. Field of the Invention

The present invention relates to centerbodies utilized in multiple annular gas turbine engine combustors to separate concentrically disposed annular combustion zones thereof and, more particularly, to centerbodies of multiple annular gas turbine engine combustors having specific geometric configurations to reduce thermal stresses thereon.

2. Description of Related Art

Centerbodies are well known in the combustor art of gas turbine engines for separating or segregating concentric combustion zones of multiple annular combustors, as seen in U.S. Pats. Nos. 5,197,278 and 5,289,687. In particular, such centerbodies are useful for isolating the annular combustion zone acting as the pilot stage, which ensures combustion stability at various operating points and allows dilution air to be directed into the pilot stage reaction zone. In the arrangements depicted in these patents, the centerbody is connected at its upstream end directly to the dome plate defining the combustion zones.

A second arrangement involves the incorporation of one or more centerbodies with a heat shield for a multiple annular combustor, as disclosed in U.S. Pat. No. 5,323,604. Such heat shields are utilized to protect the dome portion thereof against extreme heat caused by the flame within the combustion chamber. Since multiple annular combustors are staged according to a predetermined scheme, such as disclosed in U.S. Pat. No. 5,303,542, with respect to a triple annular combustor, the centerbodies therein are used to assist in ensuring only the desired combustion regions are lit as appropriate. This is extremely important in the overall goal of reducing emissions produced by the combustor. The centerbodies of the outer and inner heat shields may also be utilized to protect the outer and inner liners, respectively, as shown in U.S. Pat. No. 5,323,604.

It has been found that staged burner operation of a multiple annular combustor causes thermal gradients across a centerbody, which results in thermal stresses being imposed thereon that reduce its useful life. It will be undertood that such thermal gradients have an axial component and a circumferential component. To prevent the thermal stresses from reaching a level having a catastrophic effect on the centerbody, cooling air flow has generally been employed around the centerbody to reduce the changes in temperature thereacross. However, this measure is not desirable since the cooling air supply is limited by engine thermodynamics and emissions. Another measure utilized is to increase the thermal barrier coating on such a centerbody to counteract the thermal effects thereon, but this adds cost to the engine part and the thermal barrier coating loses effectiveness over time.

Accordingly, it would be desirable for a centerbody design to be developed, either separately or in conjunction with a combustor heat shield, which minimizes the effect of circumferential thermal gradients and resultant thermal stresses thereon to increase the cyclic life and durability of the centerbody without the disadvantages associated with current measures.

SUMMARY OF THE INVENTION

In accordance with a first aspect of the present invention, a multiple annular combustor for a gas turbine engine is disclosed having a plurality of concentrically disposed annular combustion zones about a centerline axis. The multiple annular combustor includes a first annular combustion zone, a second annular combustion zone, and a centerbody disposed between the first and second annular combustion zones. The centerbody has a first wall extending axially from an upstream end to a downstream end and a second wall radially spaced from the first wall extending axially from an upstream end to a downstream end, where the downstream ends of the first and second walls are connected by an aft wall and a pair of side walls to form a passage therebetween. The centerbody is geometrically configured to cause a thermoelastic neutral axis to be positioned radially with respect to the first and second walls thereof so that thermal stress imposed on the first and second walls is minimized. The upstream ends of the first and second walls are connected to a dome plate defining the first and second annular combustion zones.

In accordance with a second aspect of the present invention, a heat shield for a multiple annular combustor of a gas turbine engine is disclosed having a forward end and an aft end, with at least one centerbody extending from the aft end generally parallel to a centerline axis through the heat shield to separate adjacent radial combustor zones. The centerbody includes a first wall extending axially from an upstream end adjacent the heat shield aft end to a downstream end and a second wall radially spaced from the first wall extending axially from an upstream end adjacent the heat shield aft end to a downstream end, wherein the downstream ends of the first and second walls are connected by an aft wall and a pair of side walls to form a passage therebetween. The centerbody is geometrically configured to cause a thermoelastic neutral axis to be positioned radially with respect to the first and second walls thereof so that thermal stress on the centerbody is minimized. The design of the centerbody may differ depending upon whether it is located radially outward or radially inward of the heat shield centerline axis. In this regard, the first and second centerbody walls will have a different radius of curvature and axis of generation so that portions of the first and second centerbody walls most susceptible to thermal stresses caused by circumferential thermal gradients on the centerbody will be positioned adjacent the thermoelastic neutral axis.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
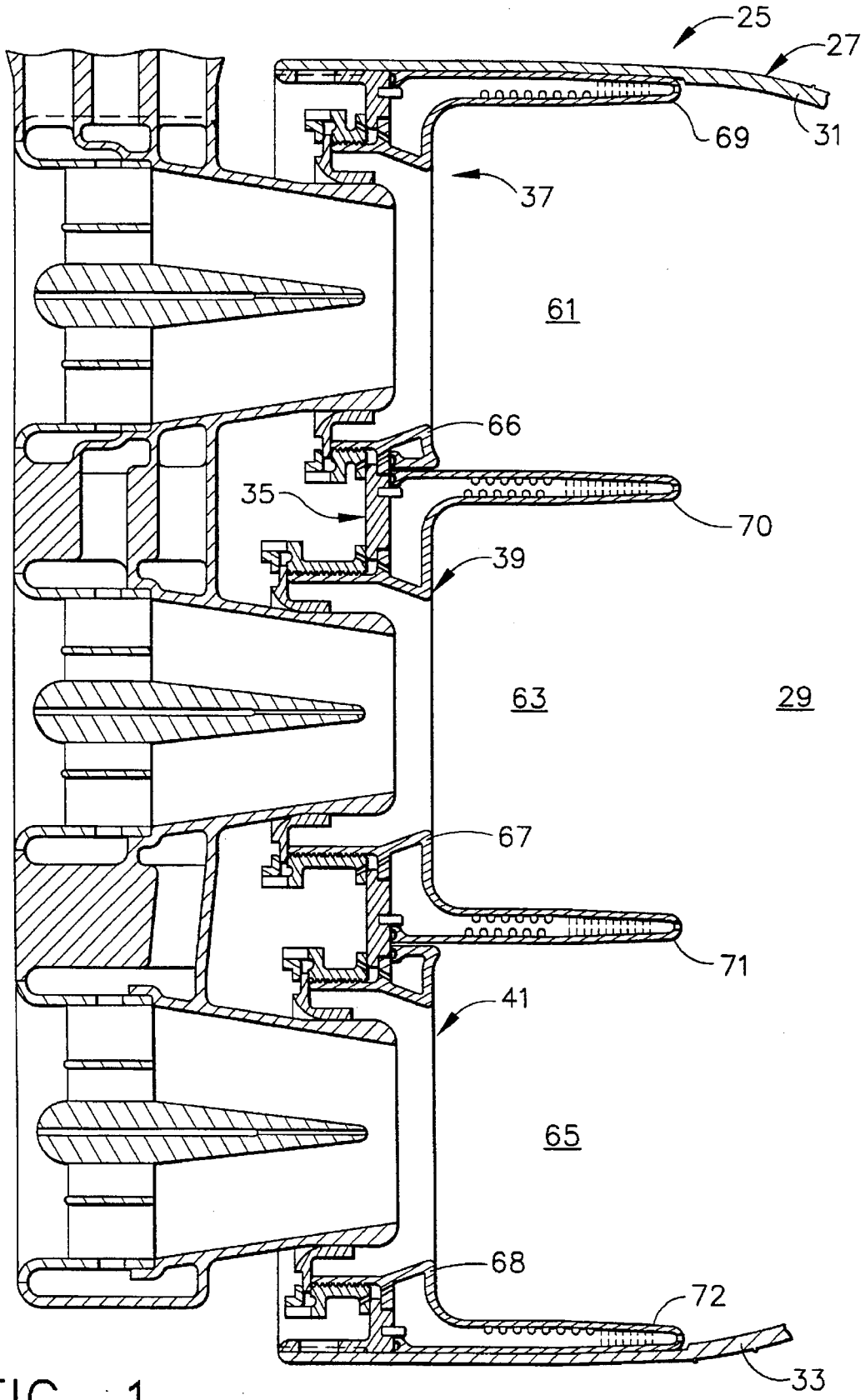
FIG. 1 (PRIOR ART)
FIG. 1 is a partial, cross-sectional schematic view of a triple annular combustor including heat shields of the present invention.
Figure 3:
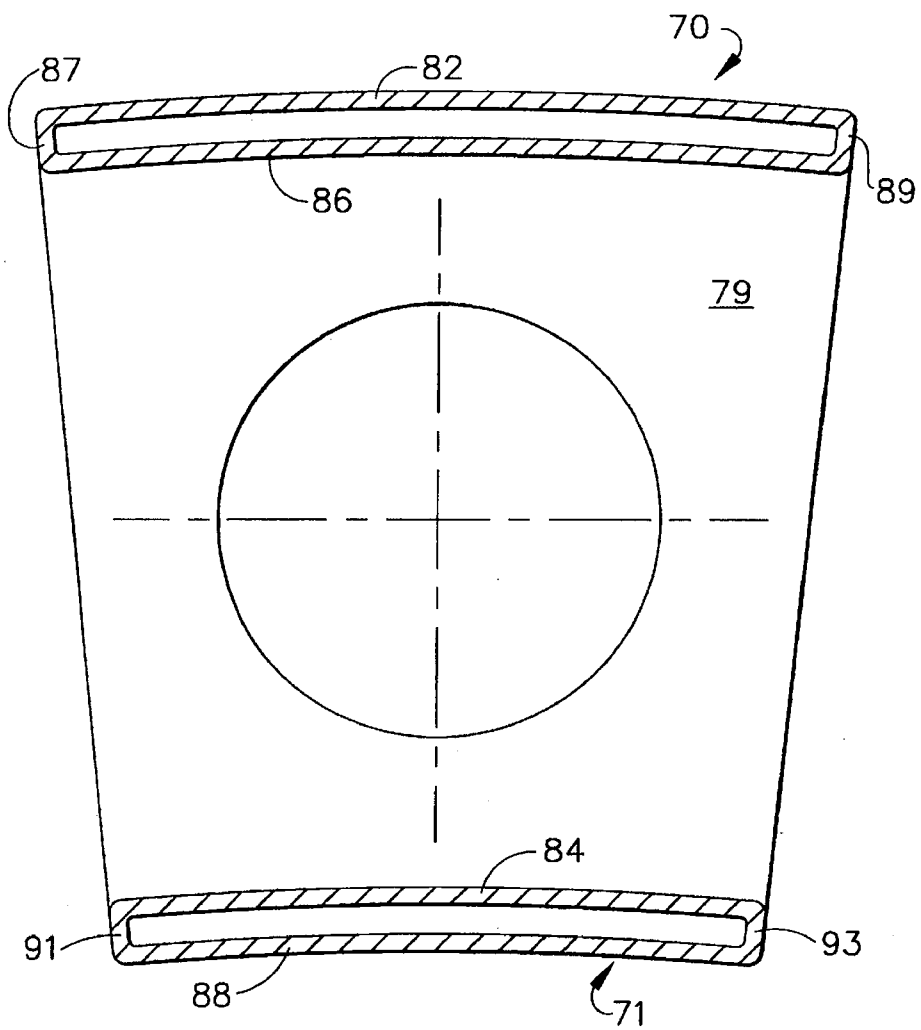
FIG. 3 is an aft looking forward view of the center heat shield taken along line 3—3 of FIG. 2.

Referring now to the drawing in detail, wherein identical numerals indicate the same elements throughout the figures, FIG. 1 depicts a multiple annular combustion apparatus 25 generally in accordance with U.S. Pat. No. 5,323,604, entitled "Triple Annular Combustor for Gas Turbine Engine," which is hereby incorporated by reference. It will be understood that combustion apparatus 25 has a hollow body 27 defining a combustion chamber 29 therein. Hollow body 27 is generally annular in form and is comprised of an outer liner 31, an inner liner 33, and a domed end or dome plate 35. In this annular configuration, domed end 35 of hollow body 27, includes three separate radial domes—outer dome 37, middle dome 39, and inner dome 41.

It will be understood that outer dome 37 includes an outer end which is fixedly joined to outer liner 31 and an inner end spaced radially inward from the outer end. Middle dome 39 has an outer end fixedly joined to the outer dome inner end and an inner end spaced radially inward from the middle dome outer end. Inner dome 41 includes an outer end fixedly joined to the middle dome inner end and an inner end spaced radially inward from the inner domed outer end which is fixedly joined to inner liner 33. Combustor 25 is conventionally mounted to the engine casing (not shown) by means of dome plate 35. Each of domes 37, 39 and 41 include therein a plurality of circumferentially spaced openings for receiving mixers for mixing air and fuel prior to entry into combustion chamber 29. Since combustion apparatus 25 is predicated on an extremely well mixed flame, air/fuel mixers are preferably in accordance with that disclosed in U.S. Pat. No. 5,351,477 entitled "Dual Fuel Mixer for Gas Turbine Combustor," which is also owned by the Assignee of the present invention and is hereby incorporated by reference.

Heat shields 66, 67 and 68 are provided in order to protect dome plate 35 against extreme heat caused by flames within each dome, and are comprised of a plurality of elements circumferentially positioned around annular combustor 25, preferably in association with each of the openings for the mixers in each dome. It is preferred that heat shields 66, 67 and 68 generally have the design of those heat shields shown and described in a patent application entitled "Dome Assembly for a Multiple Annular Combustor," Ser. No. 08/440,437, which is also owned by the Assignee of the present invention and is hereby incorporated by reference. Nevertheless, it will be understood that the particular manner in which each of the elements of heat shields 66, 67 and 68 are fixed to dome plate 35 is unimportant to the present invention, and therefore they may be either mechanically attached as shown in the patent application noted above or brazed within the dome plate 35 as described in U.S. Pat. No. 5,323,604.

It is desirable for heat shields 66, 67 and 68 to include one or more centerbodies, such as those indicated by the numerals 69, 70, 71 and 72, to segregate the individual annular combustion zones 61, 63 and 65, respectively. In this way, centerbody 69 of heat shield 66 is utilized to insulate outer liner 31 from flames burning in combustion zone 61, centerbodies 70 and 71 of heat shield 67 are utilized to segregate combustion zone 63 from combustion zones 61 and 65, and centerbody 72 of heat shield 68 is utilized to insulate inner liner 33 from flames burning in combustion zone 65.

Since combustion apparatus 25 has staged burner operation, wherein certain combustion zones will be implemented at various operation points of the engine (and indeed certain burners within a given combustion zone will be utilized at various times), thermal gradients are induced upon one or more of centerbodies 69–72 at any given time. The present invention is concerned with the thermal gradients extending circumferentially (from an axial perspective) across each heat shield element and particularly the centerbodies associated therewith. These circumferential thermal gradients, in turn, cause thermal stresses to be imposed on such a centerbody, which can reduce the life thereof unless the thermal stresses are kept within an acceptable limit. As previously stated, the only known methods for counteracting the thermal stresses imposed upon such centerbodies is to increase the flow of cooling air at such locations or increase the thickness of any thermal barrier coating applied thereto.

Figure 2:
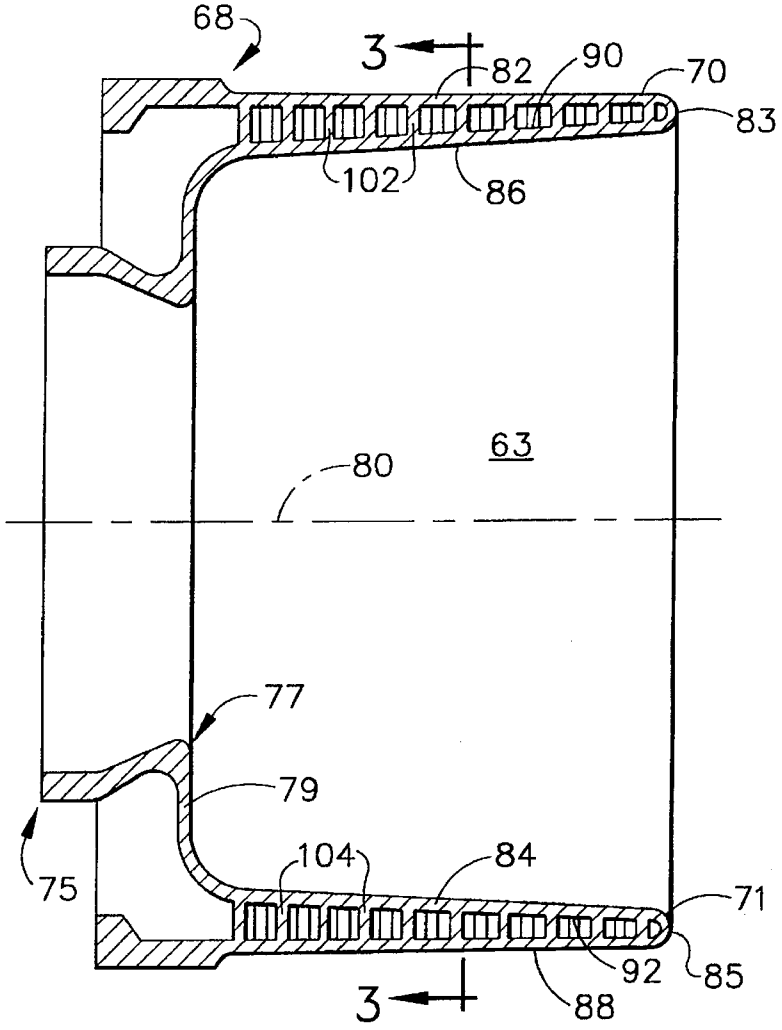
FIG. 2 is an enlarged, cross-sectional view of the center heat shield depicted in FIG. 1 including centerbodies of the present invention.

In accordance with the present invention, it has been revealed through thermal stress analysis that the effect of circumferential thermal gradients on a centerbody can be reduced when it has a certain geometric configuration, depending upon its position with respect to a flame. More specifically, as seen in FIG. 2, heat shield 67 has a forward end 75 which extends through one of a plurality of circumferentially spaced openings in dome 39 and an aft end 77 culminating in a radially extending surface 79. It will be noted that heat shield 67 includes a first centerbody 70 extending from aft end 77 generally parallel to a centerline axis 80 through heat shield 67 and located radially outward of centerline axis 80. A second centerbody 71 extends from aft end 77 generally parallel to and located radially inward of centerline axis 80. In each case, centerbodies 70 and 71 include first walls 82 and 84, respectively, extending axially from an upstream end adjacent heat shield aft end 77 to a downstream end. Second walls 86 and 88, respectively, are radially spaced from first walls 82 and 84, respectively, and extend axially from an upstream end adjacent heat shield aft end 77 to a downstream end. The downstream ends of first and second walls 82 and 86 for outer centerbody 70 and first and second walls 84 and 88 of inner centerbody 71 are shown as being connected by aft walls 83 and 85 to form coolant passages 90 and 92, respectively, therebetween. Also, it will be seen that centerbody 70 includes side walls 87 and 89 connecting first wall 82 and second wall 86 and centerbody 71 includes side walls 91 and 93 connecting first wall 84 and second wall 88.

It will be generally understood that a neutral axis will extend circumferentially through both centerbody 70 and centerbody 71. Generally, the neutral axis of an elastic body will pass through the centroid, or center of cross-sectional area. However, neutral axes 94 and 96 for centerbodies 70 and 71, respectively, are thermoelastic since elasticity of the centerbody material depends on the material temperature. Thermoelastic neutral axes 94 and 96 are shiftable depending upon the temperature distribution circumferentially across first walls 82 and 84 and second walls 86 and 88 of centerbodies 70 and 71. Thus, by properly configuring the geometry of first and second walls 82 and 86 of centerbody 70 and first and second walls 84 and 88 of centerbody 71, thermoelastic neutral axes 94 and 96 may be positioned so as to minimize the thermal stresses on centerbodies 70 and 71.

More specifically, it will be seen that thermoelastic neutral axes 94 and 96 define the so-called hot and cold sides of centerbodies 70 and 71 depending upon the staged operation of combustor 25. Of course, the particular geometric configuration of the centerbody walls involved will depend upon whether that particular centerbody is either radially inward or radially outward of centerline axis 80 for a particular combustion zone, where the "hot" side or wall of the centerbody (i.e., second wall 86 of centerbody 70 and first wall 84 of centerbody 71) is the one adjacent the flame in a combustion zone and the "cold" side or wall (i.e., first wall 82 of centerbody 70 and second wall 88 of centerbody 71) is the one furthest from the flame in a combustion zone. Because centerbodies 70 and 71 are part of each element making up heat shield 68, it will be understood that the circumferential temperature distribution across the centerbodies will not be constant. In particular, the sides of second wall 86 and first wall 84 (as well as the respective side walls of centerbodies 70 and 71) will be cooler than the middle portions of first wall 84 and second wall 86 which are located most proximate to a flame in combustion zone 63. Therefore, high tensile stresses on the sides of centerbodies 70 and 71 will develop since these cooler areas are unable to shrink due to the dominating bulk of hot material on the hot side of thermoelastic neutral axes 94 and 96. Over time, this will cause centerbodies 70 and 71 to crack in such areas and break.

Figure 4:
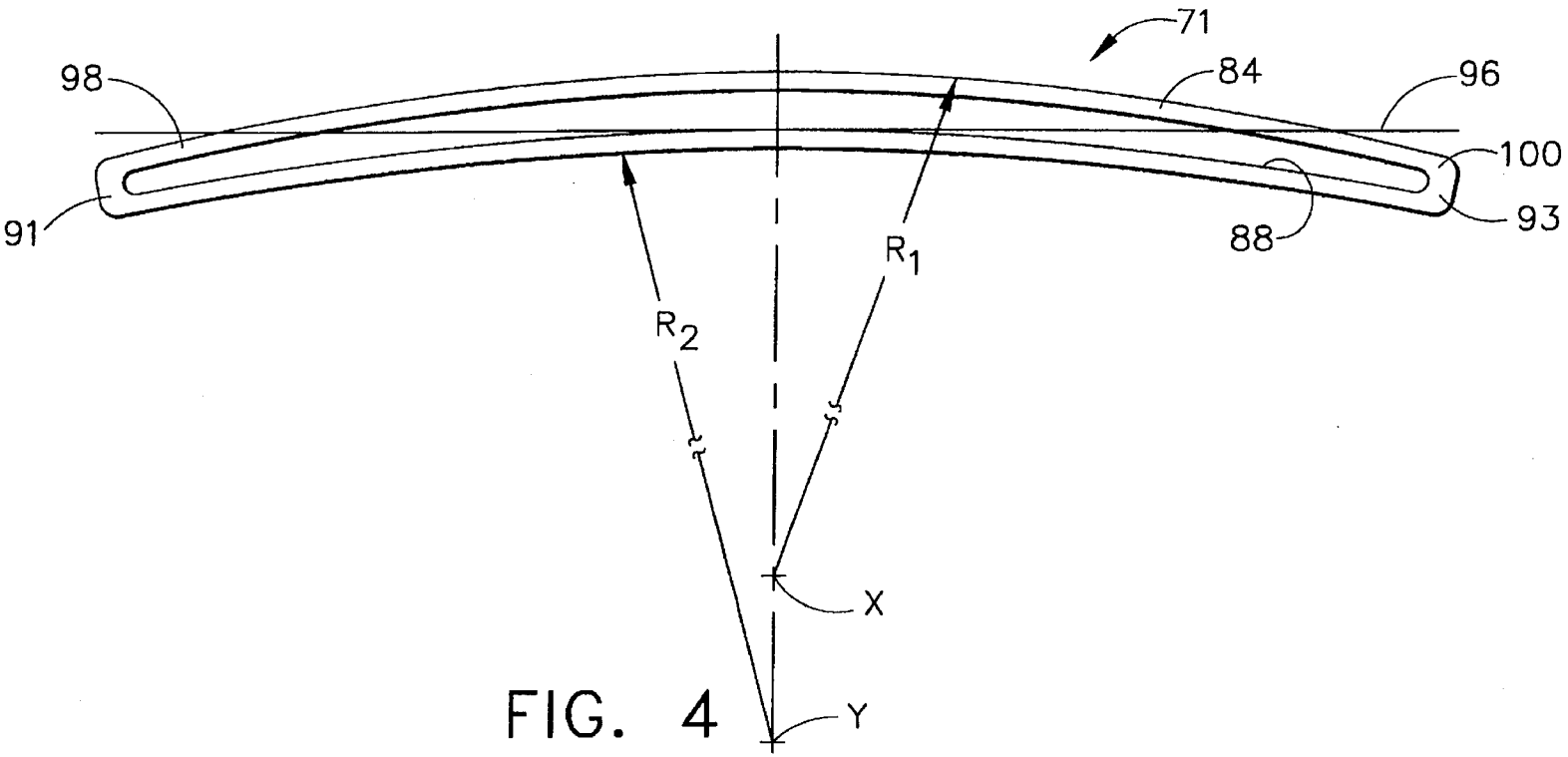
FIG. 4 is an enlarged, diagrammatic aft looking forward view of the radially inner centerbody depicted in FIG. 3.

By configuring the first and second walls 84 and 88 of centerbody 71 in a non-concentric fashion, for example, thermoelastic neutral axis 96 thereof can be shifted so cold portions (designated by the numerals 98 and 100) of first wall 84 and side walls 91 and 93 adjacent combustion zone 63 may be located on the cold side of thermoelastic neutral axis 96 while a dominating hot portion (designated by the numeral 99) of first wall 84 can remain on the hot side of thermoelastic neutral axis 96. In this way, cold portions 98 and 100 and side walls 91 and 93 are allowed to shrink to some extent so that the tensile stresses imposed thereon are significantly reduced and centerbody 71 is prevented from cracking. In particular, it will be noted that first and second walls 84 and 88 have a bi-convex configuration for centerbody 71, as depicted in FIG. 4, in order to position certain side portions of first wall 84 on the appropriate side of thermoelastic neutral axis 96. In this design, first wall 84 of centerbody 71 has a radius of curvature $R_1$ and second wall 88 has a different radius of curvature $R_2$. It is further seen that first and second centerbody walls 84 and 88 have different axes of generation x and y, respectively. In this way, the geometric configuration of centerbody 71 causes thermoelastic neutral axis 96 to be shifted radially to more appropriately accommodate the circumferential thermal gradients imposed upon centerbody 71.

Figure 5:
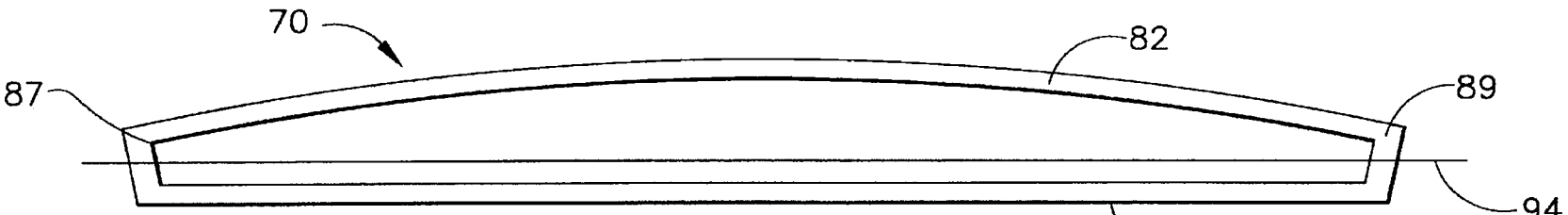
FIG. 5 is an enlarged, diagrammatic aft looking forward view of the radially outer centerbody depicted in FIG. 3.

With respect to outer centerbody 70, it has been found that first wall 82 and second wall 86 may have different circumferential cross-sections to displace thermoelastic neutral axis 94 radially inward. One such configuration would be for first wall 82 to have a cylindrical cross-section and second wall 86 to have a non-cylindrical cross-section, as seen in FIG. 5. Moreover, it has been found to be beneficial in some circumstances if first and second walls 82 and 86 are constructed so that the center of curvatures thereof lie radially outside of such walls.

It will also be seen in FIG. 2 that extended surface heat transfer mechanisms, such as in the form of pins 102 and 104, may be utilized in coolant passages 90 and 92 of centerbodies 70 and 71, respectively. In this regard, pins 102 and 104 may have varying density in the circumferential direction across centerbodies 70 and 71 in order to more favorably dispose metal temperature differences in the circumferential direction. This is particularly relevant to the situation where only certain burners in a given combustion zone or annulus are lit, whereby only the corresponding heat shields and centerbodies are affected.

Having shown and described the preferred embodiment of the present invention, further adaptations of the centerbodies incorporated into the combustor heat shield disclosed herein can be accomplished by appropriate modifications by one of ordinary skill in the art without departing from the scope of the invention. In particular, while the centerbodies shown and described in this application are associated with heat shields, the centerbodies may be attached directly to the dome plate of a multiple annular combustor and still practice the inventive design.

What is claimed is:

1. A multiple annular combustor having a plurality of concentrically disposed annular combustion zones about a centerline axis, comprising:

(a) a first annular combustion zone;

(b) a second annular combustion zone; and (c) a centerbody disposed between said first and second annular combustion zones, said centerbody further comprising:

(1) a first wall extending axially from an upstream end to a downstream end;

(2) a second wall radially spaced from said first wall extending axially from an upstream and to a downstream end, said downstream ends of said first and second walls being connected by an aft wall to form a passage therebetween; and (3) a thermoelastic neutral axis extending circumferentially through said first and second centerbody walls to define a hot side and a cold side;

wherein said first and second centerbody walls are geometrically configured to position said thermoelastic neutral axis so that cold portions of said first and second centerbody walls remain on said cold side of said thermoelastic neutral axis and hot portions of said first and second centerbody walls remain on said hot side of said thermoelastic neutral axis.

2. The multiple annular combustor of claim 1, wherein said centerbody is connected at said upstream ends of said first and second walls to a dome plate defining said first and second annular combustion zones.

3. The multiple annular combustor of claim 1, wherein said centerbody is connected at said upstream ends of said first and second walls to a heat shield positioned within an opening in a dome plate defining one of said annular combustion zones.

4. The multiple annular combustor of claim 1, said centerbody cold portions further comprising a pair of side walls connecting said first and second walls.

5. The multiple annular combustor of claim 1, further comprising:

(a) an outer liner;

(b) an inner liner disposed radially inward of said outer liner; and (c) a second centerbody disposed between said first annular combustion zone and said outer liner, said second centerbody comprising:

(1) a third wall extending axially from an upstream end to a downstream end;

(2) a fourth wall radially spaced from said third wall extending axially from an upstream end to a downstream end, said downstream ends of said third and fourth walls being connected by an aft wall to form a passage therebetween; and (3) a thermoelastic neutral axis extending circumferentially through said third and fourth centerbody walls to define a hot side and a cold side;

wherein said third and fourth centerbody walls are geometrically configured to position said thermoelastic neutral axis so that cold portions of said third and fourth centerbody walls remain on said cold side of said thermoelastic neutral axis and hot portions of said third and fourth centerbody walls remain on said hot side of said thermoelastic neutral axis.

6. The multiple annular combustor of claim 1, further comprising:

(a) an outer liner;

(b) an inner liner disposed radially inward of said outer liner; and (c) a second centerbody disposed between said second annular combustion zone and said inner liner, said second centerbody comprising:

(1) a third wall extending axially from an upstream end to a downstream end;

(2) a fourth wall radially spaced from said third wall extending axially from an upstream end to a downstream end, said downstream ends of said third and fourth walls being connected by an aft wall to form a passage therebetween; and (3) thermoelastic neutral axis extending circumferentially through said third and fourth centerbody walls to define a hot side and a cold side;

wherein said third and fourth centerbody walls are geometrically configured to position said thermoelastic neutral axis so that cold portions of said third and fourth centerbody walls remain on said cold side of said thermoelastic neutral axis and hot portions of said third and fourth centerbody walls remain on said hot side of said thermoelastic neutral axis.

7. The multiple annular combustor of claim 1, wherein said centerbody is comprised of a plurality of elements arranged circumferentially to substantially form an annular body between said first and second annular combustion zones.

8. The multiple annular combustor of claim 1, wherein said first and second centerbody walls are not concentric from an axial perspective.

9. The multiple annular combustor of claim 1, wherein said first and second centerbody walls have different radii of curvature and axes of generation from an axial perspective.

10. The multiple annular combustor of claim 1, wherein said first centerbody wall has a cylindrical cross-section from an axial perspective and said second wall has a non-cylinder cross-section from an axial perspective.

11. The multiple annular combustor of claim 1, said centerbody cold portions further comprising side portions of said first centerbody wall.

12. The multiple annular combustor of claim 1, said centerbody hot portions further comprising a middle portion of said first centerbody wall.

13. The multiple annular combustor of claim 1, said centerbody cold portions further comprising said second centerbody wall.

14. A heat shield for a multiple annular combustor of a gas turbine engine having a centerline axis, comprising:

(a) a forward end and an aft end; and (b) at least one centerbody extending axially from said heat shield aft end generally parallel to a centerline axis through said heat shield to separate radially adjacent combustor annuli, said centerbody further comprising:

(1) a first wall extending axially from an upstream end adjacent said heat shield aft end to a downstream end;

(2) a second wall radially spaced from said first wall extending axially from an upstream end adjacent said heat shield aft end to a downstream end, said downstream ends of said first and second walls being connected by an aft wall to form a passage therebetween; and (3) a thermoelastic neutral axis extending circumferentially through said first and second centerbody walls to define a hot side and a cold side;

wherein said first and second centerbody walls are geometrically configured to position said thermoelastic neutral axis so that cold portions of said first and second centerbody walls remain on said cold side of said thermoelastic neutral axis and hot portions of said first and second centerbody walls remain on said hot side of said thermoelastic neutral axis.

15. The heat shield of claim 12, wherein said centerbody is located radially outward of said heat shield centerline axis.

16. The heat shield of claim 14, wherein said centerbody is located radially inward of said heat shield centerline axis.

17. The heat shield of claim 14, wherein said first and second centerbody walls have a different radius of curvature.

18. The heat shield of claim 14, wherein said first and second centerbody walls have a different axis of generation.

19. The heat shield of claim 14, wherein said centerbody first wall has a substantially cylindrical cross-section and said centerbody second wall has a non-cylindrical cross-section.

20. The heat shield of claim 14, wherein side portions of said first centerbody wall are located on a cold side of said thermoelastic neutral axis and a middle portion of said first centerbody wall is located on a hot side of said thermoelastic neutral axis.

* * * * *